US009482399B2

(12) United States Patent
Rimsky et al.

(10) Patent No.: US 9,482,399 B2
(45) Date of Patent: Nov. 1, 2016

(54) LIGHT TUBE KIT FOR SKYLIGHT

(71) Applicant: VKR Holding A/S, Hoersholm (DK)

(72) Inventors: Charles Joseph Rimsky, Greenwood, SC (US); Jeffrey Joseph Ronan, Greenwood, SC (US); Alan John Ruhoff, Greenwood, SC (US)

(73) Assignee: VKR HOLDING A/S, Hørsholm (DK)

( * ) Notice: Subject to any disclaimer, the term of this patent is extended or adjusted under 35 U.S.C. 154(b) by 247 days.

(21) Appl. No.: 13/837,229

(22) Filed: Mar. 15, 2013

(65) Prior Publication Data

US 2014/0268863 A1 Sep. 18, 2014

(51) Int. Cl.
*E04D 13/03* (2006.01)
*F21S 11/00* (2006.01)

(52) U.S. Cl.
CPC ..... *F21S 11/007* (2013.01); *E04D 13/03* (2013.01); *E04D 2013/0345* (2013.01)

(58) Field of Classification Search
CPC ..... E04D 2013/0345; E04D 2013/034; F21S 11/00; E04B 9/32; Y10T 24/44026; Y10T 24/44778
USPC ..... 52/843–845, 200, 28; 250/205; 359/591; 403/326, 327, DIG. 14; 292/299, 250, 246, 194, 256.69, 285, 292/304; 138/158, 160, 168
See application file for complete search history.

(56) References Cited

U.S. PATENT DOCUMENTS 669,929 A * 3/1901 Johnson ..... 292/262
1,190,759 A * 7/1916 Harrington ..... 403/274
2,160,009 A * 5/1939 Walker ..... 138/149
2,463,079 A * 3/1949 Albrecht ..... 24/578.1
4,221,039 A * 9/1980 Smith ..... 29/271
4,474,167 A * 10/1984 McCabe ..... 126/287.5
4,733,987 A * 3/1988 Tomlinson et al. ..... 403/326
4,809,468 A 3/1989 Bareiss
5,099,622 A 3/1992 Sutton
5,502,935 A * 4/1996 Demmer ..... 52/200
5,509,241 A * 4/1996 Coconis et al. ..... 52/232
5,546,712 A 8/1996 Bixby
5,595,427 A * 1/1997 Peters et al. ..... 312/140.4
5,596,848 A 1/1997 Lynch
D382,347 S 8/1997 Grubb (Continued)

FOREIGN PATENT DOCUMENTS

DE 20 2005 009 483 U1 10/2005
DK 202005009483 U1 9/2005
WO 2009/110283 A1 9/2009

OTHER PUBLICATIONS

Communication Under Rule 71(3) PCT—Intention to Grant, Dec. 10, 2015.

(Continued)

*Primary Examiner* — Elizabeth A Quast
*Assistant Examiner* — Kyle Walraed-Sullivan
(74) *Attorney, Agent, or Firm* — Timothy D. St. Clair; Nexsen Pruet, LLC

(57) ABSTRACT

A light tube kit for skylight with a light tunnel and a spring clip. The light tunnel may be configured from a sheet member rolled upon itself such that two opposite edges overlap, such overlapped edges secured with the spring clip engaged through slots proximate to the overlapped edges. The spring clip has first and second hooks that are engaged through such slots and a handle disposed between the hooks.

17 Claims, 6 Drawing Sheets

(56) References Cited

U.S. PATENT DOCUMENTS

| | | | | |
|---|---|---|---|---|
| 5,655,339 | A | 8/1997 | DeBlock et al. | |
| 5,878,539 | A | 3/1999 | Grubb | |
| 5,879,101 | A * | 3/1999 | Hagura | 403/326 |
| 5,896,712 | A * | 4/1999 | Chao | 52/200 |
| 5,896,713 | A | 4/1999 | Chao et al. | |
| 5,983,581 | A | 11/1999 | DeBlock et al. | |
| 6,035,593 | A | 3/2000 | Chao et al. | |
| 6,142,645 | A | 11/2000 | Han | |
| 6,219,977 | B1 | 4/2001 | Chao et al. | |
| 6,256,947 | B1 | 7/2001 | Grubb | |
| 6,321,493 | B1 * | 11/2001 | Rillie et al. | 52/200 |
| 6,363,667 | B2 | 4/2002 | O'Neill | |
| 6,363,668 | B2 | 4/2002 | Rillie et al. | |
| 6,412,238 | B2 | 7/2002 | Rillie et al. | |
| 6,415,563 | B2 | 7/2002 | Rillie et al. | |
| 6,438,803 | B2 | 8/2002 | Rillie et al. | |
| 6,523,483 | B1 * | 2/2003 | Trent | B61D 17/16 105/377.07 |
| 6,528,782 | B1 | 3/2003 | Zhang et al. | |
| 6,604,329 | B2 | 8/2003 | Hoy et al. | |
| 6,623,137 | B1 | 9/2003 | Marsonette | |
| 6,725,615 | B1 * | 4/2004 | Porter | 52/232 |
| 6,813,864 | B2 | 11/2004 | Landis | |
| 6,918,216 | B2 | 7/2005 | Hoy et al. | |
| 6,990,773 | B2 | 1/2006 | Borges | |
| 7,040,061 | B2 | 5/2006 | Rillie et al. | |
| 7,082,726 | B2 | 8/2006 | Prenn et al. | |
| 7,146,768 | B2 | 12/2006 | Rillie | |
| 7,159,364 | B2 | 1/2007 | Rillie | |
| 7,168,211 | B2 | 1/2007 | Prenn et al. | |
| 7,185,464 | B2 | 3/2007 | Bracale | |
| 7,234,279 | B2 | 6/2007 | Sincic et al. | |
| 7,322,156 | B1 | 1/2008 | Rillie et al. | |
| 7,380,377 | B2 | 6/2008 | Brinton et al. | |
| 7,546,709 | B2 | 6/2009 | Jaster et al. | |
| 7,621,081 | B2 | 11/2009 | Rillie | |
| 7,757,444 | B1 | 7/2010 | Halliday | |
| 7,954,281 | B2 | 6/2011 | Jaster | |
| 7,957,065 | B2 | 6/2011 | Jaster | |
| 7,976,189 | B2 | 7/2011 | Osborn | |
| 8,018,653 | B2 | 9/2011 | Jaster | |
| 8,370,999 | B2 * | 2/2013 | Camus | 24/295 |
| 8,555,571 | B2 * | 10/2013 | Darmer et al. | 52/200 |
| 8,958,157 | B2 * | 2/2015 | Rillie et al. | 359/593 |
| 2001/0013207 | A1 | 8/2001 | O'Neill | |
| 2001/0049914 | A1 | 12/2001 | Rillie et al. | |
| 2001/0049915 | A1 | 12/2001 | Rillie et al. | |
| 2001/0049916 | A1 | 12/2001 | Rillie et al. | |
| 2001/0052208 | A1 | 12/2001 | Rillie et al. | |
| 2001/0052209 | A1 | 12/2001 | Rillie et al. | |
| 2003/0000159 | A1 | 1/2003 | Estrada | |
| 2003/0066254 | A1 | 4/2003 | DeBlock | |
| 2003/0233738 | A1 * | 12/2003 | Osterland et al. | 24/293 |
| 2004/0083582 | A1 * | 5/2004 | Dickinson | F16B 5/0614 24/295 |
| 2007/0266652 | A1 | 11/2007 | Jaster et al. | |
| 2009/0113824 | A1 | 5/2009 | Rillie | |
| 2010/0061088 | A1 * | 3/2010 | Bartol et al. | 362/184 |
| 2010/0251621 | A1 * | 10/2010 | Donoho | 49/493.1 |
| 2011/0044041 | A1 | 2/2011 | Jaster | |
| 2011/0141570 | A1 | 6/2011 | Rillie et al. | |
| 2011/0149401 | A1 | 6/2011 | Jaster | |
| 2011/0162304 | A1 | 7/2011 | Jaster | |
| 2013/0314795 | A1 * | 11/2013 | Weaver | 359/591 |
| 2013/0333312 | A1 * | 12/2013 | Fooks | 52/200 |
| 2014/0160570 | A1 * | 6/2014 | Jaster | 359/597 |
| 2014/0268347 | A1 * | 9/2014 | Rillie et al. | 359/597 |

OTHER PUBLICATIONS

EP2778513 71-3, Text Intended for Grant.
European Search Report, Application No, EP1401508758.

* cited by examiner

Fig. 5
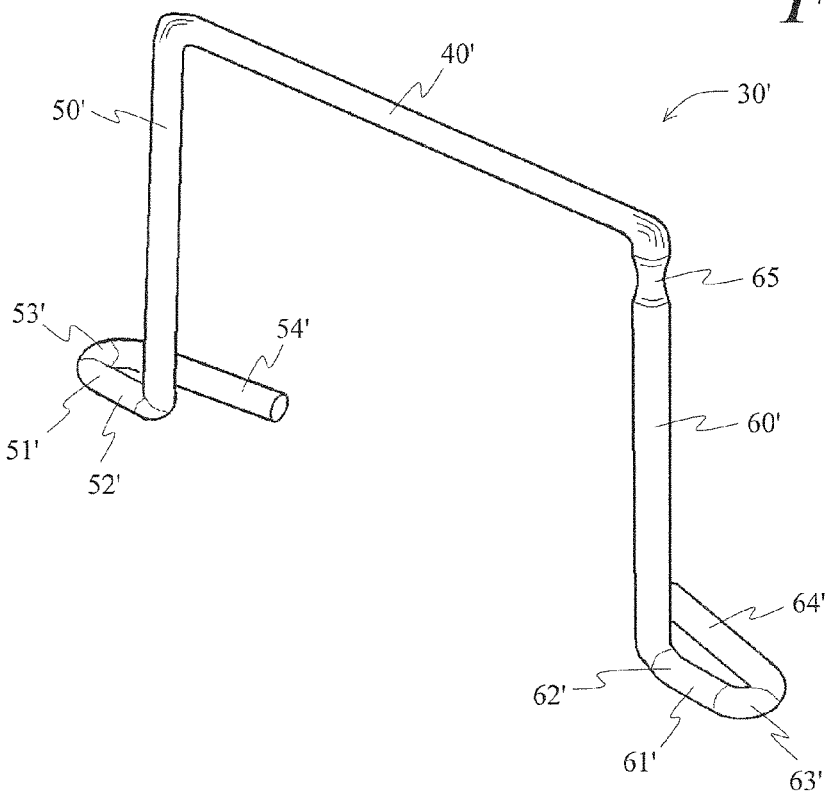
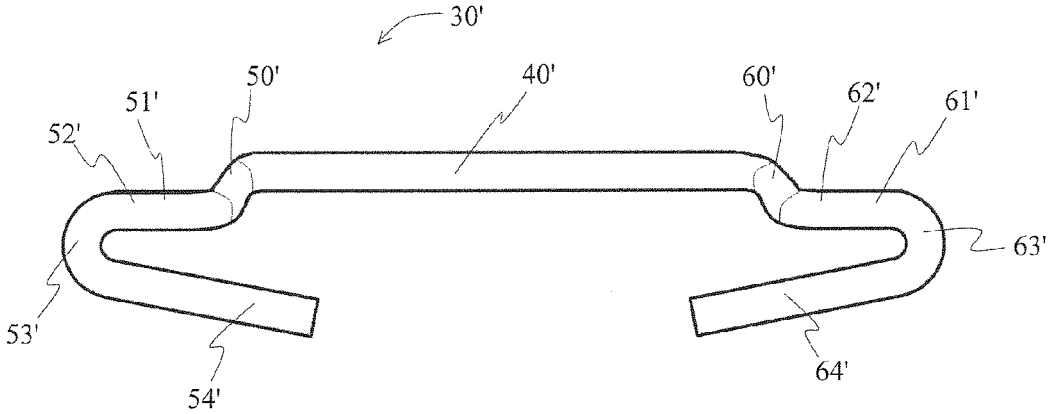
Fig. 6

Fig. 8
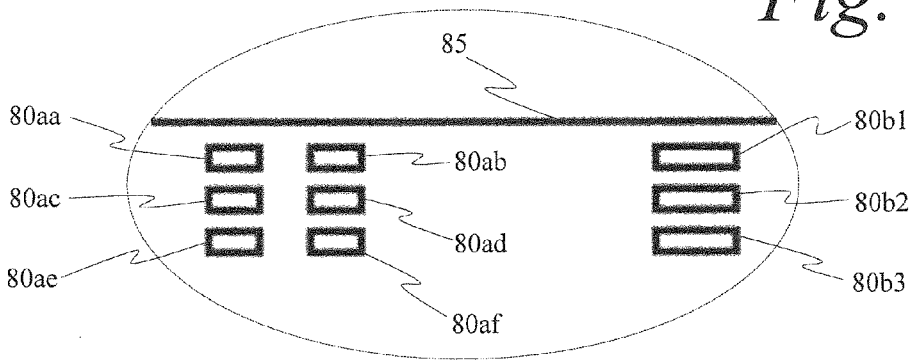
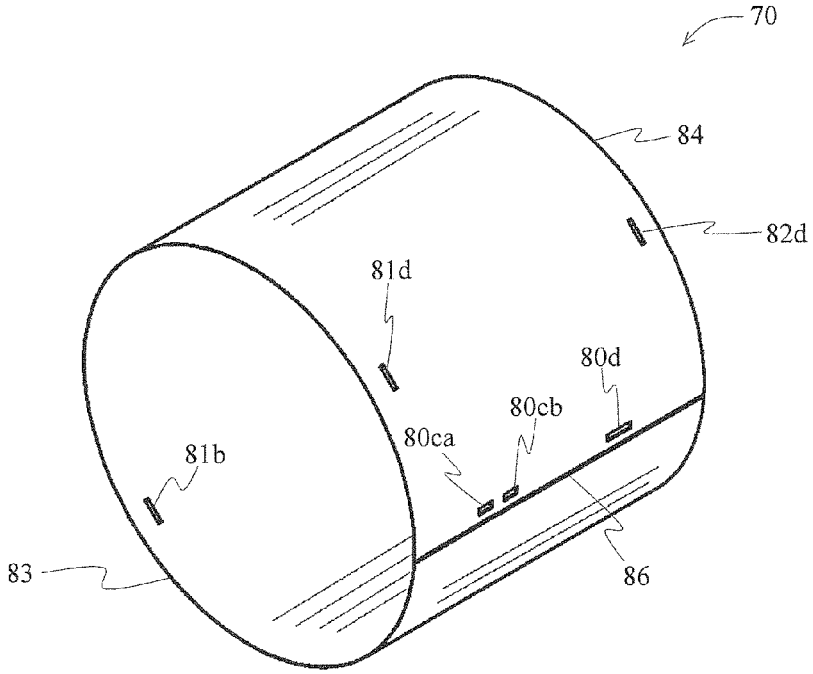
Fig. 9

Fig. 10
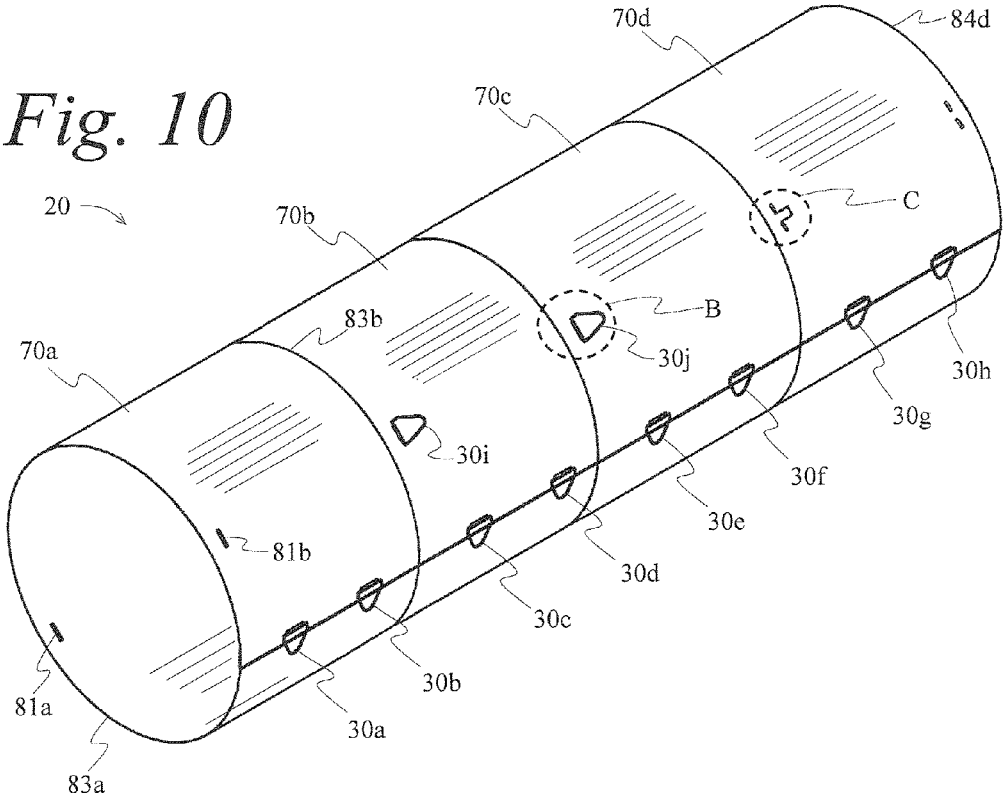
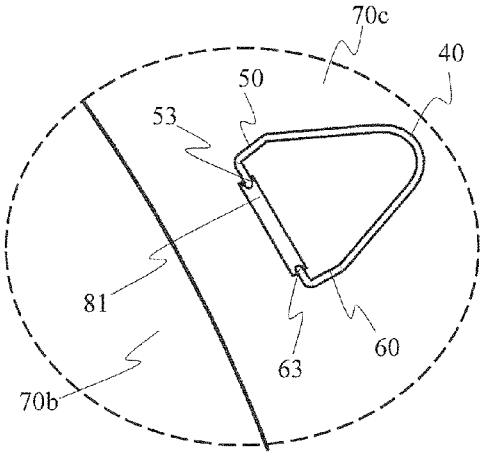
Fig. 11
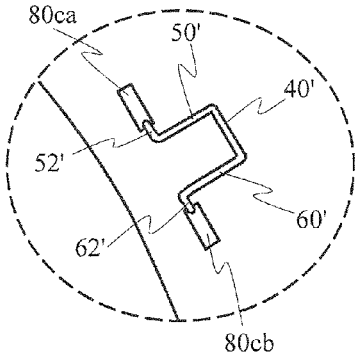
Fig. 12

LIGHT TUBE KIT FOR SKYLIGHT

TECHNICAL FIELD

The present invention relates generally to a skylight light tube kit, and, more particularly, to a combination of a tube body configured from rolling a sheet upon itself and secured together with spring clips engaged through slots defined within the tube body.

BACKGROUND

Skylights provide desirable natural lighting for building interiors, increasing visual attractiveness and reducing energy usage.

A skylight includes a rooftop element through which sunlight enters the skylight structure, a diffuser at the building interior, and a channel between the rooftop element and diffuser to convey light from the first to the second.

One configuration of such a skylight is a tubular skylight, in which the channel is a tube, often of circular cross-section, which may have a reflective interior surface.

Some tubular skylights are provided with pre-assembled light tubes. However, provision of pre-assembled light tubes may be disadvantageous, in that they are bulky and therefore more difficult and more expensive to transport. Furthermore, because of the thin metal with which they are often constructed, pre-assembled light tubes may be damaged during shipment or from handling.

Other designs of light tubes call for construction of the light tube on-site. Such designs are provided with the light tube initially as an unrolled sheet of material. At the installation site, the light tube is fabricated by rolling the sheet upon itself, overlapping two opposed edges, then installing screws through the overlapped edges. While offering certain advantages, such a design likewise suffers certain disadvantages. For example, it has been found that the force of feeding a screw through the rolled, overlapped sheet material is prone to deform the sheet material. Furthermore, this design can be assembled with the light tube inadvertently fixed at an improper diameter. Additionally, labor costs on-site are often the most expensive of those involved in building construction, but this design increases assembly time on-site and therefore increases labor costs.

Installation of a tubular skylight may proceed as follows. With new construction, the building is first "weathered in," including installation of the exterior cover for the skylight at the building roof. Second, the interior ceiling is installed. It is only after those two steps are completed that a light tube itself is installed between the exterior cover and the interior ceiling. Similarly, in retrofitting a tubular skylight to an existing structure, the exterior cover would first be installed, then the interior diffuser would be installed in a room interior ceiling. Thereafter, a light tube would be configured between those two elements. In both instances, at least two challenges may be presented. First, precise placement of the diffuser relative to the exterior cover may be misjudged. Second, the precise length needed for the light tube between those two elements may be misjudged. In either circumstance, it would be desirable to have a light tube the components of which could provide side-to-side adjustment of the lower end relative to the upper end for those cases in which the diffuser has not been positioned exactly, relative to optimal placement with regard to the location of the exterior cover. Furthermore, it would be desirable to have a light tube that could be easily fabricated and assembled within the space, yet telescope upon itself so as to fully and completely span the distance between those two elements.

SUMMARY OF THE INVENTION

In response to the foregoing background, a new light tube kit for a skylight is provided. As revealed in the following description and the figures herein, this invention discovers an effective technology that simply but reliably provides for construction of a skylight tube that may be quickly constructed yet adjusted in-place to provide for a sound finished skylight system.

In accordance with certain aspects of certain embodiments of the present technology, a combination is provided that includes a light tunnel. The light tunnel may be configured from a sheet member having a first edge and a second edge that is opposite the first edge. Third and fourth edges may be disposed between the first and second edges. The sheet member may be rolled upon itself such that the third edge overlaps the fourth edge.

A first slot may be defined through the sheet member proximate to the third edge and a second slot may be defined through the sheet member proximate to the fourth edge. With the sheet member rolled upon itself such that the third edge overlaps the fourth edge, the first and second slots may be aligned.

A spring clip may be further provided. The spring clip may have first and second hooks and a handle disposed between them. The first hook may be disposed through the first and second slots and engaged therewith. In certain configurations, the second hook may also be disposed through the first and second slots and engaged therewith.

In particular embodiments, the first slot may be parallel to the third edge and the second slot may be parallel to the fourth edge. A third slot may be included, the third slot residing between the first slot and the third edge and being parallel to the first slot.

In other applications, a third slot may be included that is parallel to the first slot and located approximately the same distance from the third edge as is the first slot; a fourth slot may also be included that is parallel to the second slot and located approximately the same distance from the fourth edge as is the second slot. In such applications, the first hook may be disposed through the first and second slots and engaged therewith and the second hook may be disposed through the third and fourth slots and engaged therewith.

In certain configurations, the first and second hooks may open away from each other. In other configurations, the first and second hooks may open toward each other.

In some examples, the first hook may reside in a first position relative to the second hook and be movable to a second position relative to the second hook, at such second position the first hook being biased toward the first position.

In particular examples, a slot may be included that is proximate to the first edge. Likewise, for certain configurations, the spring clip handle may reside outboard of the light tunnel.

In accordance with yet additional aspects of other embodiments of the present technology, a skylight tunnel kit is provided. The kit may include a quadrilateral sheet that defines first and second slots therethrough proximate to its perimeter. The sheet may be rolled upon itself to form a tube body, such that the first and second slots are aligned.

A spring clip may be provided, having first and second hooks. This spring clip may be interfitted with the aligned slots by engaging the first hook through the first and second slots to secure the first and second slots together.

In specific illustrations, the first and second hooks may open away from each other. In other examples, the first and second hooks may open toward each other.

In certain configurations, the first hook may reside in a first position relative to the second hook and be movable to a second position relative to the second hook, at such second position the first hook being biased toward the first position.

In particular applications, the handle may reside outboard of the light tunnel.

In accordance with still further aspects of other embodiments of the present technology, a skylight tunnel combination is provided. The combination may include first and second rectangular sheets, each rectangular sheet having two edge slots and one end slot defined therethrough. Each rectangular sheet may be rolled upon itself such that the two edge slots align. A first spring clip may be provided, the first spring clip having first and second hooks, the first hook being disposed through the two aligned edge slots and engaged therewith. Further, the first rectangular sheet may be telescoped into the second rectangular sheet such that the end slot defined through the first rectangular sheet aligns with the end slot defined through the second rectangular sheet. A second spring clip may be provided, the second spring clip having first and second hooks, the first hook disposed through the end slot defined through the first rectangular sheet and the end slot defined through the second rectangular sheet, and engaged therewith.

In particular embodiments, the first hook may reside in a first position relative to the second hook and be movable to a second position relative to the second hook, at such second position the first hook being biased toward the first position. In some examples, the first and second hooks of the spring clips may open away from each other and, in other examples, the first and second hooks may open toward each other; examples of each configuration may be used in a single skylight tunnel kit.

The preceding description sets forth certain features of the present invention so that the detailed description below may be better understood and so that the contributions of this invention may be better appreciated. Additional advantages of the invention will be set forth in part in the detailed description below, and in part, may be obvious from the detailed description or may be learned by practicing the invention. The advantages of the invention will be realized by means of the elements and combinations particularly pointed out in the appended claims. It is to be understood that both the foregoing general description as well as the following detailed description are only examples and are merely explanatory, not restrictive of the invention.

BRIEF DESCRIPTION OF THE DRAWINGS

The details of the present technology, both as to its structure and operation, can be better understood with reference to the accompanying figures. It should be noted that these figures are not necessarily to scale in all instances.

FIG. 5. is a perspective view of an embodiment of a spring clip in accordance with certain aspects of the present invention;

FIG. 6 is a bottom view of an embodiment of a spring clip in accordance with certain aspects of the present invention;

FIG. 8 is an enlarged perspective view of an embodiment of slots in a light tube kit for a skylight, taken at A in FIG. 7.

FIG. 9 is a perspective view of an embodiment of a light tunnel in accordance with certain aspects of the present invention;

FIG. 10 is a perspective view of an embodiment of a light tube kit for a skylight in accordance with certain aspects of the present invention FIG. 11 is an enlarged perspective view of an embodiment of a spring clip in a light tube kit for a skylight, taken at B in FIG. 10; and FIG. 12 is an enlarged perspective view of an embodiment of a spring clip in a light tube kit for a skylight, taken at C in FIG. 10.

DETAILED DESCRIPTION

Figure 1:
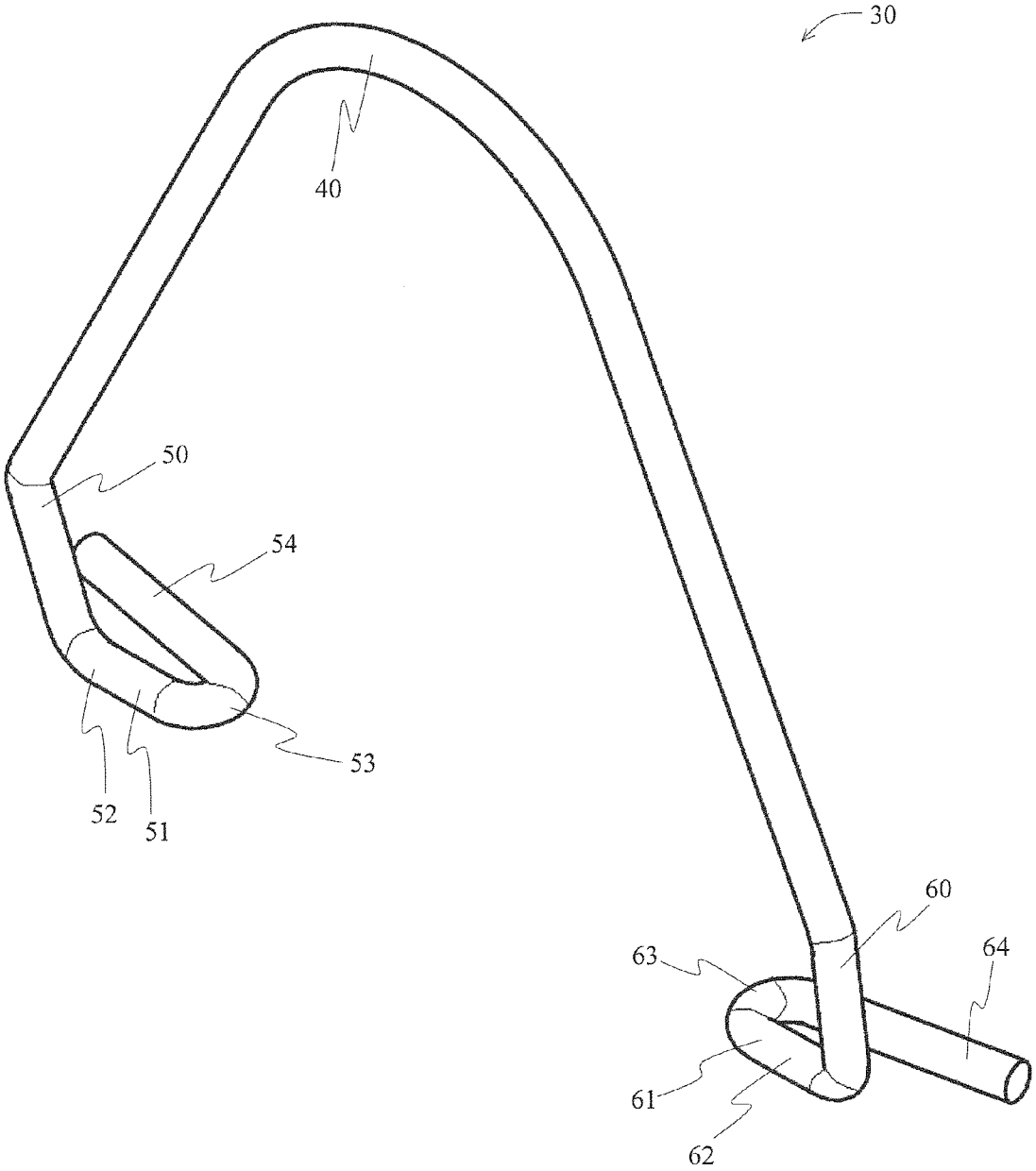
FIG. 1 is a perspective view of an embodiment of a spring clip in accordance with certain aspects of the present invention.

Selected combinations of aspects of the disclosed technology correspond to a plurality of different embodiments of the present invention. It should be noted that each of the exemplary embodiments presented and discussed herein should not insinuate limitations of the present subject matter. Features illustrated or described as part of one embodiment may be used in combination with aspects of another embodiment, to yield yet further embodiments. Certain features may be interchanged with similar devices or features not expressly mentioned, which perform the same or similar function. It is to be understood that this invention is not limited to the specific devices and methods disclosed herein unless otherwise specified. It is to be understood also that the terminology used herein is for the purpose of describing particular aspects only and is not intended to be limiting.

A light tube kit 20 for a skylight is provided. Kit 20 includes a spring clip 30 and light tube 70.

Spring clip 30 may include a handle 40 that terminates at one end at a first stem 50 and, at the other end, at a second stem 60. Stem 50 may connect handle 40 to first hook 51 and stem 60 may connect handle 40 to a second hook 61. In certain embodiments, hook 51 may include a first shank 52, first elbow 53, and first tip 54. Second hook 61 may include a second shank 62, a second elbow 63, and a second tip 64. First hook 51 and second hook 61 may open away from each other or may open toward each other.

For installation with a light tube 70, first hook 51 and second hook 61 may be urged toward each other relative to handle 40 (if hook 51 and second hook 61 open away from each other) or urged away from each other relative to handle 40 (if hook 51 and second hook 61 open toward each other). In some configurations, advantageously first hook 51 may reside in a first position relative to second hook 61 and be movable to a second position relative to second hook 61 at which first hook 51 is biased toward the first position.

Light tube 70 may be fabricated from a sheet member. The sheet member may be of any suitable material, for example, metal. In certain embodiments, it may be desirable that at least one surface of the sheet member, that surface which will be the interior surface of light tube 70 when assembled, be coated or treated so as to be reflective of visible light.

Light tube 70 may include plural edge slots 80. Furthermore, in some embodiments light tube 70 may include upper end slots 81 and, in particular illustrations, may include lower end slots 82.

The sheet member for light tube 70 may be understood to have a first edge 83, second edge 84, third edge 85, and fourth edge 86. The use of edge slots 80 may be of several designs in a light tube 70. For example, a first edge slot 80*b* may reside, singly, proximate to third edge 85 and a second edge slot 80*d* may reside, singly, proximate to fourth edge 86. A light tube 70 of such a design may be fabricated by rolling the sheet member upon itself so that third edge 85 overlaps fourth edge 86. Edge slot 80*b* may thereby be aligned with edge slot 80*d*. Once aligned, a spring clip 30 may be used to secure third edge 85 with fourth edge 86, thereby creating a light tube 70. More particularly, a spring clip 30 with first and second hooks 51, 61 opening away from each other may be interfitted into aligned slots 80*b*, 80*d* such that first hook 51 and second hook 61 engage through slots 80*b*, 80*d*. Specifically, first hook 51 may wrap around one end of aligned slots 80*b*, 80*d* such that first shank 52 resides outboard of edge slots 80*b*, 80*d* and first tip 54 resides inboard of edge slots 80*b*, 80*d*; similarly, second hook 61 may wrap around the other end of aligned slots 80*b*, 80*d* such that second shank 62 resides outboard of edge slots 80*b*, 80*d* and second tip 64 reside inboard of edge slots 80*b*, 80*d*; third edge 85 thereby being secured with fourth edge 86, creating a light tube 70.

A second design of edge slots 80 may be used in a light tube 70, in alternative to or in conjunction with the design described in the preceding paragraph. With such second design, a first pair of edge slots 80*aa*, 80*ab* may reside proximate to third edge 85 and a second pair of edge slots 80*ca*, 80*cb* may reside proximate to fourth edge 86. Edge slot pair 80*aa*, 80*ab* may include a first edge slot 80*aa* parallel to a second edge slot 80*ab*, edge slots 80*aa*, 80*ab* residing approximately equidistant from third edge 85 (with the ends of edge slots 80*aa*, 80*ab* closest to each another understood to be the respective medial ends and the opposite ends understood to be the respective distal ends). Likewise, edge slot pair 80*ca*, 80*cb* may include a first edge slot 80*ca* parallel to a second edge slot 80*cb*, edge slots 80*ca*, 80*cb* residing approximately equidistant from fourth edge 86. A light tube 70 of such a design may be fabricated by rolling the sheet member upon itself so that third edge 85 overlaps fourth edge 86. Edge slot 80*aa* may thereby be aligned with edge slot 80*ca* and edge slot 80*ab* may thereby be aligned with edge slot 80*cb*. Once so aligned, a spring clip 30 with may be interfitted into aligned slots 80*aa*, 80*ca* and 80*ab*, 80*cb*. For example, with a spring clip 30 in which first hook 51 and second hook 61 open away from each other, first hook 51 may wrap around the distal ends of aligned slots 80*ca*, 80*aa* such that first shank 52 resides outboard of edge slots 80*ca*, 80*aa* and first tip 54 resides inboard of edge slots 80*ca*, 80*aa*; similarly, second hook 61 may wrap around the distal ends of aligned slots 80*cb*, 80*ab* such that second shank 62 resides outboard of edge slots 80*cb*, 80*ab* and second tip 64 resides inboard of edge slots 80*cb*, 80*ab*; third edge 85 thereby being secured with fourth edge 86, creating a light tube 70. Alternatively, with a spring clip 30 in which first hook 51 and second hook 61 open toward each other, first hook 51 may wrap around the medial ends of aligned slots 80*ca*, 80*aa* such that first shank 52 resides outboard of edge slots 80*ca*, 80*aa* and first tip 54 resides inboard of edge slots 80*ca*, 80*aa*; similarly, second hook 61 may wrap around the medial ends of aligned slots 80*cb*, 80*ab* such that second shank 62 resides outboard of edge slots 80*cb*, 80*ab* and second tip 64 reside inboard of edge slots 80*cb*, 80*ab*; third edge 85 thereby being secured with fourth edge 86, creating a light tube 70.

The light tube kit 20 may be further configured for telescoping a light tube 70*a* into a second light tube 70*b*. Such a configuration may be achieved as follows. Edge slots 80 may be dimensioned such that they are wider than hooks 51, 61 of spring clip 30. In one embodiment, for example, edge slots 80 may be 3-4 millimeters in width whereas hooks 51, 61, may be less than two millimeters in width. So configured, the overlap of third edge 85 with fourth edge 86 may be adjusted by moving third edge 85 relative to fourth edge 86, even with spring clip 30 installed, such that light tube 70 becomes slightly tapered or frusto-conical. Such dimensioning and such latitude allows for a light tube 70 to achieve a nominal diameter, yet allows small adjustment of such diameter as circumstances may require. By adjustment of the overlap of third edge 85 with fourth edge 86, as allowed by the relative dimensioning of a slot 80 and hooks 51, 61, light tube 70 may be tapered so as to allow one end of a light tube 70*a* to be inserted into another end of a second light tube 70*b*. Further, by including one or more slots 80 along a first edge 83 and/or second edge 84 of each light tube 70*a*, 70*b*, once telescoped together light tubes 70*a*, 70*b* may be secured by use of a spring clip 30 interfitted between overlapping edge slots, for example, 81*c*, 82*c*, of light tubes 70*a*, 70*b* respectively.

Alternatively, or additionally, light tube kit 20 may be configured for telescoping a light tube 70*a* into a second light tube 70*b* with different designs of edge slots 80. A first edge slot 80*b*3 may be included proximate to third edge 85. A second edge slot 80*b*2 may be included between first edge slot 80*b*3 and third edge 85 and generally parallel to first edge slot 80*b*3. For some applications, additional edge slots, for example edge slot 80*b*1, may be included between second edge slot 80*b*2 and third edge 85. A light tube 70 of such a design may be fabricated by rolling the sheet member upon itself so that third edge 85 overlaps fourth edge 86. Edge slot 80*b*3 may thereby be aligned with edge slot 80*d* to fabricate a light tube 70 of a particular diameter, or edge slot 80*b*2 may thereby be aligned with edge slot 80*d* to fabricate a light tube 70 of a larger diameter (or edge slot 80*b*1 may thereby be aligned with edge slot 80 to fabricate a light tube 70 of a still larger third diameter); once aligned, a spring clip 30 may be used to secure third edge 85 with fourth edge 86, thereby creating a light tube 70. Light tube 70 may thereby be selectively cylindrical or conical, depending upon user choice for a given application.

A further design of edge slots 80 may be used in a light tube 70, in alternative to or in conjunction with the designs previously described. Particularly, a first pair of edge slots 80*ae*, 80*af* may reside proximate to third edge 85. Edge slot pair 80*ae*, 80*af* may include edge slot 80*ae* parallel to edge slot 80*af*, edge slots 80*ae*, 80*af* residing approximately equidistant from third edge 85. A second pair of edge slots 80*ca*, 80*cb* may reside proximate to fourth edge 86. Edge slot pair 80*ca*, 80*cb* may include edge slot 80*ca* parallel to edge slot 80*cb*, edge slots 80*ca*, 80*cb* residing approximately equidistant from fourth edge 86. A third pair of edge slots, 80*ac*, 80*ad* may be included between first pair of edge slots 80*ae*, 80*af* and third edge 85 and generally parallel to first pair of edge slots 80*ae*, 80*af*. For some applications, additional pairs of edge slots, for example edge slots 80*aa*, 80*ab*, may be included between third pair of edge slots, 80*ac*, 80*ad* and third edge 85. A light tube 70 of such a design may be fabricated by rolling the sheet member upon itself so that third edge 85 overlaps fourth edge 86. Edge slots 80*ae*, 80*af* may thereby be aligned with edge slots 80*ca*, 80*cb*, respectively, to fabricate a light tube 70 of a particular diameter, or edge slots 80*ac*, 80*ad* may thereby be aligned with edge slots 80*ca*, 80*cb*, respectively, to fabricate a light tube 70 of a larger diameter (or edge slots 80*aa*, 80*ab* may thereby be aligned with edge slots 80*ca*, 80*cb*, respectively, to fabricate a light tube 70 of a still larger third diameter); once aligned, a spring clip 30 may be used to secure third edge 85 with fourth edge 86, thereby creating a light tube 70. Light tube 70 may thereby be selectively cylindrical or conical, depending upon user choice for a given application.

Figure 2:
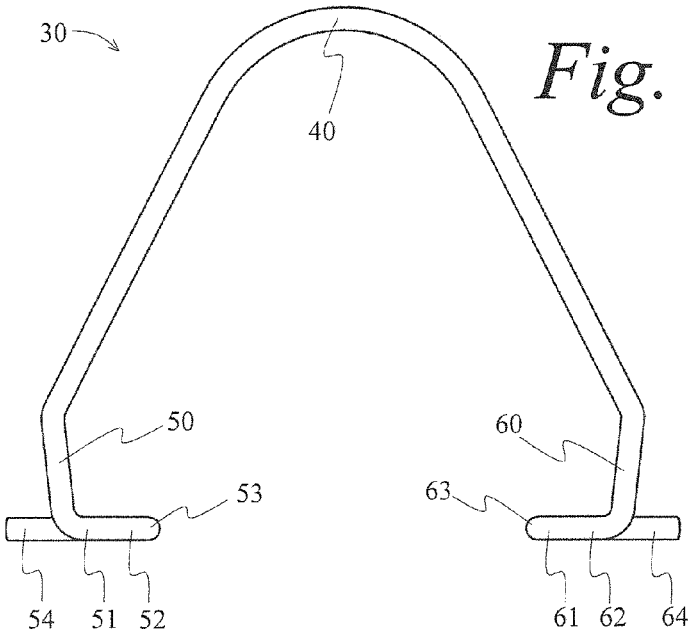
FIG. 2 is a front elevation view of an embodiment of a spring clip in accordance with certain aspects of the present invention.
Figure 3:
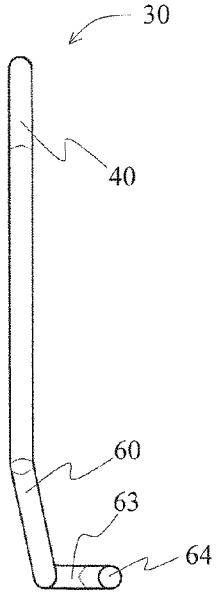
FIG. 3 is a right side elevation view of an embodiment of a spring clip in accordance with certain aspects of the present invention.
Figure 4:
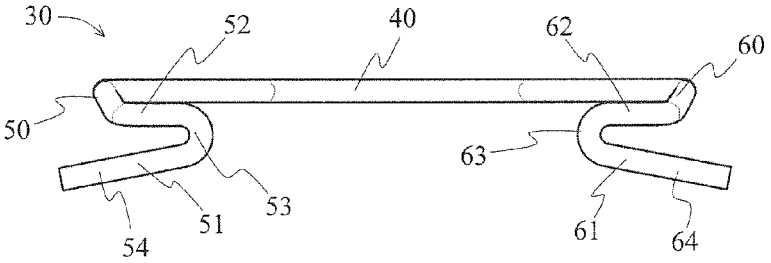
FIG. 4 is a bottom view of an embodiment of a spring clip in accordance with certain aspects of the present invention.

FIGS. 1, 2, 3, and 4 illustrate one embodiment of a spring clip 30. A handle 40 is provided that terminates at a first stem 50 and a second stem 60. Stem 50 connects handle 40 to first hook 51 and stem 60 connects handle 40 to second hook 61. Handle 40 in FIGS. 1 and 2 is of a particular curvilinear shape that allows for hook 51 and hook 61 to be urged toward each other for installation of spring clip 30 into a slot 80, 81, or 82; once so installed, spring clip 30 may be released and hooks 51, 61 will attempt to return to their original respective positions, thereby engaging in a slot 80, 81, or 82. The particular curvilinear geometry of the handle 40 illustrated in FIGS. 1-4 is not by limitation; any geometry that would allow hooks 51, 61 to be interfitted into a slot 80, 81, or 82 and engage therethrough may be utilized. It will be observed in FIGS. 1, 2, 3, and 4 that hook 51 may include a first shank 52, first elbow 53, and first tip 54. Similarly, hook 61 may include a second shank 62, second elbow 63, and second tip 64.

It will be further observed in FIG. 2 that, from a front elevation view, hooks 51, 61 may reside in a single plane in some embodiments. Such a configuration may aid in the installation of a spring clip 30 into a slot 80, 81, or 82. It will be still further observed in FIG. 4 that, from a bottom view, first tip 54 and second tip 64 may be non-parallel and instead splay, a configuration that, for certain applications, may aid in the installation of a spring clip 30 into a slot 80, 81, or 82.

FIGS. 5 and 6 illustrate another embodiment of a spring clip 30'. A handle 40' terminates at a first stem 50' and at a second stem 60'. Stem 50' connects handle 40' to first hook 51' and stem 60' connects handle 40' to second hook 61'. Hook 51' and hook 61' open toward each other and may be urged away from each other for installation of spring clip 30' into a pair of slots, for example 80*ca*, 80*cb*; once so installed, spring clip 30' may be released and hooks 51', 61' will attempt to return to their original respected positions, thereby engaging in pair of slots, for example 80*ca*, 80*cb*. It will be observed in FIGS. 5 and 6 that hook 51' may include a first shank 52', first elbow 53', and first tip 54'. Similarly, hook 61' may include a second shank 62', second elbow 63', and second tip 64'.

Spring clip 30 may be made of metal, plastic, or other resilient material that would allow, first, for hooks 51, 61 to be urged toward one another for installation into a slot 80, 81, or 82 and thereafter, upon release, return to an engaged position with such slot.

The subject invention further teaches that, with some applications, it may be desirable for one of first hook 51 or second hook 61 to move relative to handle 40 as the first hook 51 and second hook 61 are urged together or apart from each other for installation into a slot 80, 81, or 82, or in a pair of slots, for example 80*ca*, 80*cb*, as the case may be, while the other of first hook 51 or second hook 61 does not move relative to handle 40. An example of a design providing such alternative is depicted in FIG. 5, which includes relief 65 along second stem 60'. Relief 65 may be an indentation, notch, collar, or other feature that allows second hook 61' to move relative to handle 40' as the first hook 51' and second hook 61' are urged together or apart while first hook 51' does not move relative to handle 40'.

Figure 7:
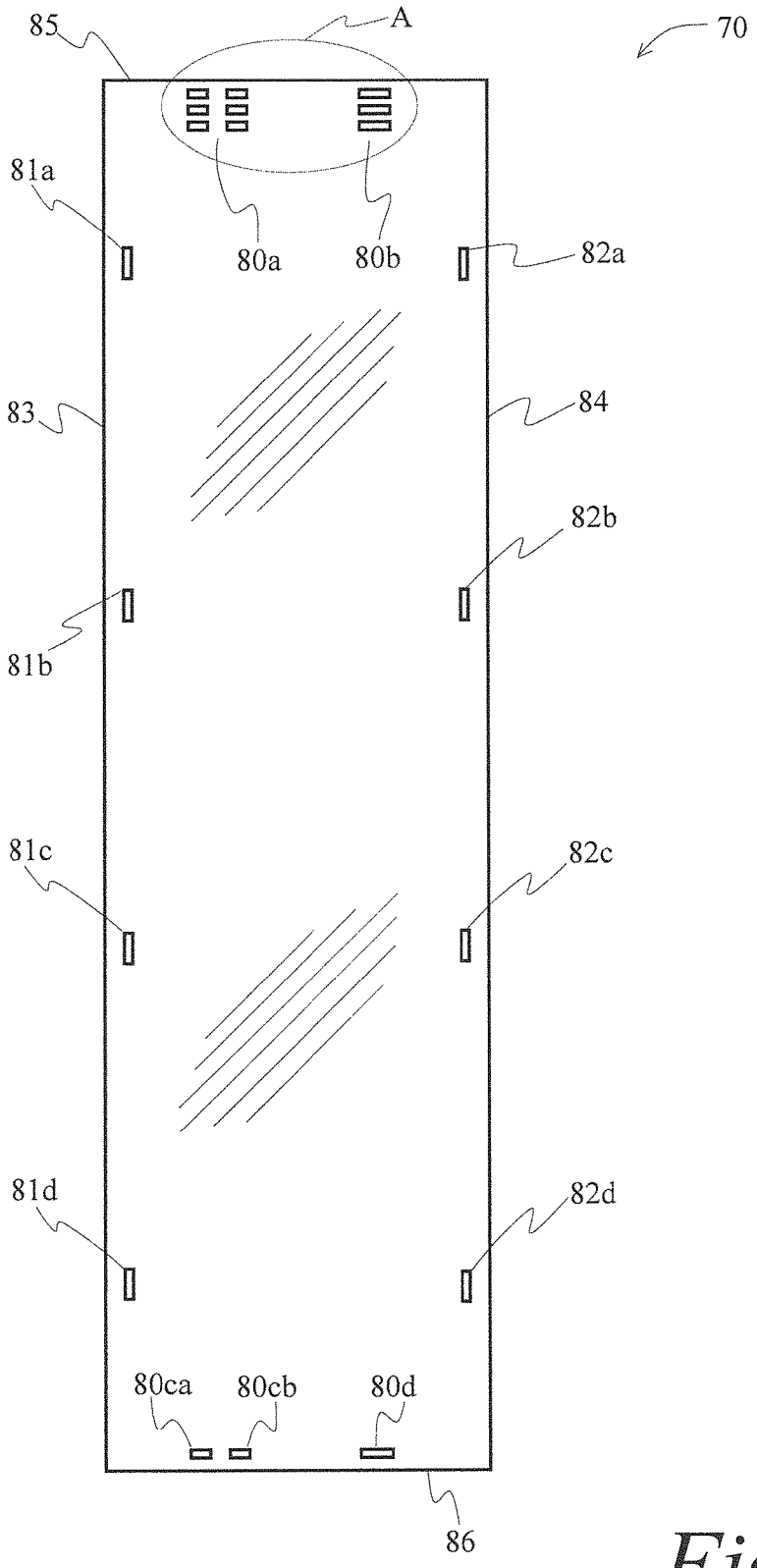
FIG. 7 is a plan view of an embodiment of a sheet member for a light tunnel in accordance with certain aspects of the present invention.

FIG. 7 depicts a sheet member for construction a light tube 70. The sheet member of light tube 70 includes a first edge 83, second edge 84, third edge 85, and fourth edge 86. In the embodiment depicted in FIG. 5, plural edge slots 80*a, b, c*, and *d* are illustrated. Further, plural upper end slots 81*a, b, c*, and *d* are illustrated. Still further, plural lower end slots 82*a, b, c*, and *d* are illustrated.

FIG. 8 depicts two embodiments of edge slot design, showing edge slot pairs 80*aa*, 80*ab* and 80*ac*, 80*ad* and 80*ae*, 80*af* together with edge slots 80*b*1, 80*b*2, 80*b*3.

FIG. 9 illustrates a light tube 70 partially-assembled from the sheet member depicted in FIG. 7. As depicted in FIG. 8, light tube 70 has been fabricated by rolling the sheet member upon itself so that third edge 85 overlaps fourth edge 86. Edge slots 80*ca* and 80*cb* have been aligned with edge slots 80*aa*, 80*ab*, or edge slots 80*ac*, 80*ad*, or edge slots 80*ae*, 80*af* (not shown). Further, edge slot 80*d* has been aligned with edge slot 80*b*1, 80*b*2, or 80*b*3 (not shown). For illustration, the first edge 83, along with upper end slots 81*a, b*, and lower end slot 82*a*, are depicted.

FIG. 10 depicts an embodiment of a completed light tube kit 20 for a skylight. In the embodiment shown, light tube 70*a* has been fabricated by rolling a sheet member upon itself and secured with spring clips 30*a, b*. First edge 83*a* of light tube 70*a* is shown. Similarly, a second light tube 70*b* has been similarly fabricated; first edge 83*b* of light tube 70*b* is illustrated. In the kit depicted in FIG. 7, second edge 84*a* (not shown) of light tube 70*a* has been inserted within light tube 70*b* beyond first edge 83*b* of light tube 70*b*. Light tubes 70*a*, 70*b* have then been secured together by use of spring clip 30*i* engaged in an upper edge slot. In similar fashion, light tube 70*b* has been inserted within light tube 70*c* and light tube 70*c* has been inserted within light tube 70*d*. The edge slot design alternatives described above, and/or the relative sizing of spring clip 30 to the dimensions of a slot 80, 81, or 82, allow light tube 70*a, b, c*, and *d* to be adjusted such that they are slightly tapered and thereby can be telescoped one into another. Further, considering the relative dimensioning of spring clips 30*i, j*, and *k*, light tubes 70*a, b, c*, and *d* may be laterally adjusted relative to another, such that first edge 83*a* of light tube 70*a* is not aligned directly with second edge 84*d* of light tube 70*d*; such side-to-side adjustment of the position of first edge 83*a* relative to second edge 84*d* would allow for more complete and sound connection between an upper skylight cover and a lower skylight diffuser that had not been positioned as aligned exactly with one another.

FIG. 11 depicts a spring clip 30 engaged with an upper slot 81 (shown) and a lower slot 82 (not shown). For installation, stem 50 and stem 60 have been urged toward one another, along with their respective hooks 51 and 61 with hooks 51, 61 then inserted through slot 81 and slot 82. Spring clip 30 was then released, with hooks 51, 61 engaged in slots 81, 82. It will be seen that FIG. 8 depicts elbows 53, 63 residing against the distal edges of slot 81.

FIG. 12 depicts a spring clip 30' engaged with an upper slot pair 80*ca*, 80*cb*. For installation, stem 50' and stem 60' have been urged away from one another, along with their respective hooks 51' and 61' with hooks 51', 61' then inserted through slot 80*ca* and slot 80*cb*, respectively. Spring clip 30' was then released, with hooks 51', 61' engaged in slots 80*ca*, 80*cb*. It will be seen that FIG. 8 depicts shanks 52', 62' residing against the medial edges of slots 80*ca*, 80*cb*.

From this disclosure, a new light tube kit for a skylight is provided. The kit provides for installation of a tubular skylight either in new construction or into an existing building. Even in those circumstances in which the exterior cover and interior diffuser have already been installed, with the light tube to be fitted last, the present invention provides a light tube kit that may be quickly constructed yet adjusted in-place to provide for a sound finished skylight system. The system allows for a measure of side-to-side adjustment of the lower end relative to the upper end for those cases in which the interior diffuser has not been positioned exactly relative to the exterior cover. Further, the kit provides a light tube that is easily fabricated and assembled, yet can telescope upon itself so as to fully and completely span the distance between the upper cover and the lower diffuser.

The embodiments of the present invention described above are not exhaustive nor do they limit the invention to the precise forms disclosed. Rather, the described embodiments are chosen so that others skilled in the art to which this invention pertains may appreciate and understand the principles and practice of the present invention. The scope of the present invention fully encompasses other embodiments that may become obvious to those skilled in the art and is, accordingly, to be limited by nothing more than the appended claims.

The invention claimed is:

1. A light tunnel combination, comprising:

a light tunnel, the light tunnel configured from a sheet member having a first edge and a second edge opposite the first edge, with opposed third and fourth edges disposed between the first and second edges, the sheet member rolled upon itself such that the third edge overlaps the fourth edge;

a first slot defined through the sheet member proximate to the third edge and a second slot defined through the sheet member proximate to the fourth edge, the first and second slots being aligned and overlapping when the sheet member is rolled upon itself;

a spring clip, the spring clip having first and second hooks and a handle disposed therebetween; and the first hook disposed through the first and second slots and engaged therewith and the second hook disposed through the first and second slots and engaged therewith, the handle disposed on and outboard of the light tunnel.

2. The combination of claim 1, wherein the first slot is parallel to the third edge and the second slot is parallel to the fourth edge.

3. The combination of claim 1, further including a third slot residing between the first slot and the third edge and being parallel to the first slot.

4. A light tunnel combination, comprising:

a light tunnel, the light tunnel configured from a sheet member having a first edge and a second edge opposite the first edge, with opposed third and fourth edges disposed between the first and second edges, the sheet member rolled upon itself such that the third edge overlaps the fourth edge;

a first slot defined through the sheet member proximate to the third edge and a second slot defined through the sheet member proximate to the fourth edge, the first and second slots being aligned and overlapping when the sheet member is rolled upon itself;

a third slot parallel to the first slot and residing equidistant from the third edge with the first slot and a fourth slot parallel to the second slot and residing equidistant from the fourth edge with the second slot, the third and fourth slots being aligned and overlapping when the sheet member is rolled upon itself;

a spring clip, the spring clip having first and second hooks and a handle disposed therebetween; and the first hook disposed through the first and second slots and engaged therewith and the second hook disposed through the third and fourth slots and engaged therewith, the first hook includes a first shank disposed directly adjacent to the handle and the second hook includes a second shank also disposed directly adjacent to the handle;

wherein the first and second shanks are positioned upon the sheet member.

5. The combination of claim 1, wherein the first and second hooks are open away from each other.

6. The combination of claim 1, wherein the first and second hooks are open toward each other.

7. The combination of claim 1, wherein the first hook resides in a first position relative to the second hook, the first hook being movable to a second position relative to the second hook at which the first hook is biased toward the first position.

8. The combination of claim 1, further including a third slot proximate to the first edge.

9. A skylight tunnel kit, comprising:

a skylight tunnel tube body configured from a quadrilateral sheet having a first edge and a second edge opposite the first edge, with opposed third and fourth edges disposed between the first and second edges, the quadrilateral sheet member defining first and second slots therethrough and a perimeter, the first slot positioned proximate the third edge, and the second slot positioned proximate to the fourth edge, the quadrilateral sheet rolled upon itself such that third edge overlaps the fourth edge and such that the first and second slots are aligned and overlap;

a spring clip having first and second hooks and a handle disposed therebetween; and the first hook disposed through the first and second slots and engaged therewith and the second hook disposed through the first and second slots and engaged therewith, the handle disposed on and outboard of the quadrilateral sheet.

10. The skylight tunnel kit of claim 9, wherein the first and second hooks are open away from each other.

11. The skylight tunnel kit of claim 9, wherein the first and second hooks are open toward each other.

12. The skylight tunnel kit of claim 9, wherein the first hook resides in a first position relative to the second hook, the first hook being movable to a second position relative to the second hook at which the first hook is biased toward the first position.

13. The skylight tunnel kit of claim 9, wherein the handle resides outboard of the light tunnel.

14. The combination of claim 4, wherein the first and second hooks are open away from each other.

15. The combination of claim 4, wherein the first and second hooks are open toward each other.

16. The combination of claim 4, wherein the handle resides outboard of the light tunnel.

17. The combination of claim 4, wherein the first slot is parallel to the third edge and the second slot is parallel to the fourth edge.

* * * * *